US009890783B2

(12) United States Patent
Wilkinson et al.

(10) Patent No.: US 9,890,783 B2
(45) Date of Patent: Feb. 13, 2018

(54) PUMP ASSEMBLY WITH CHARGE PUMP ROTOR, INVERSION PUMP ROTOR AND SCAVENGE PUMP ROTOR

(71) Applicant: HAMILTON SUNDSTRAND CORPORATION, Charlotte, NC (US)

(72) Inventors: Andrew R. Wilkinson, Cherry Valley, IL (US); Andrew P. Grosskopf, Rockford, IL (US)

(73) Assignee: HAMILTON SUNDSTRAND CORPORATION, Charlotte, NC (US)

( * ) Notice: Subject to any disclaimer, the term of this patent is extended or adjusted under 35 U.S.C. 154(b) by 102 days.

(21) Appl. No.: 14/949,407

(22) Filed: Nov. 23, 2015

(65) Prior Publication Data

US 2017/0146013 A1 May 25, 2017

(51) Int. Cl.

| | |
|---|---|
| ***F03C 2/00*** | (2006.01) |
| ***F03C 4/00*** | (2006.01) |
| ***F04C 2/00*** | (2006.01) |
| ***F04C 11/00*** | (2006.01) |
| ***F04C 15/00*** | (2006.01) |
| ***F04C 15/06*** | (2006.01) |

(52) U.S. Cl.

CPC ..... *F04C 11/003* (2013.01); *F04C 15/0073* (2013.01); *F04C 15/06* (2013.01); *F04C 2240/30* (2013.01); *F04C 2270/0525* (2013.01); *F04C 2270/205* (2013.01)

(58) Field of Classification Search

CPC .... F04C 11/003; F04C 15/0073; F04C 15/06; F04C 2240/30; F04C 2270/0525; F04C 2270/205

USPC ..... 418/210, 259, 266–268

See application file for complete search history.

(56) References Cited

U.S. PATENT DOCUMENTS 4,619,594 A 10/1986 Moir

FOREIGN PATENT DOCUMENTS

| | | |
|---|---|---|
| EP | 2511474 A2 | 10/2012 |
| WO | 2014068343 A1 | 5/2014 |

OTHER PUBLICATIONS

EP SR, dated Mar. 28, 2017, EP Application No. 16200287.7, 11 pages.

*Primary Examiner* — Theresa Trieu

(74) *Attorney, Agent, or Firm* — Cantor Colburn LLP

(57) ABSTRACT

A pump assembly is provided and includes a housing having first, second and third pairs of fluid openings and first, second and third rotary pumps, which are co-rotatable about a common longitudinal axis defined through the housing to drive fluid flow relative to the first, second and third pairs of fluid openings, respectively. The first rotary pump includes an input member receptive of rotational drive energy for the first, second and third rotary pumps.

18 Claims, 4 Drawing Sheets

PUMP ASSEMBLY WITH CHARGE PUMP ROTOR, INVERSION PUMP ROTOR AND SCAVENGE PUMP ROTOR

BACKGROUND OF THE DISCLOSURE

The subject matter disclosed herein relates to a pump assembly and, more particularly, to a pump assembly with a charge pump rotor, an inversion pump rotor and a scavenge pump rotor.

A pump is a device that moves fluids (liquids or gases) or sometimes slurries by mechanical action. Pumps can be classified into three major groups according to the method they use to move the fluid. These include direct lift, displacement and gravity pumps. A displacement pump (or a positive displacement pump) makes a fluid move by trapping a fixed amount and forcing or displacing that trapped volume into a discharge pipe. Some positive displacement pumps use an expanding cavity on a suction side and a decreasing cavity on the discharge side. Liquid flows into the pump as the cavity on the suction side expands and the liquid flows out of the discharge as the cavity collapses. The volume is constant through each cycle of operation.

A positive displacement pump can be further classified according to the mechanism used to move the fluid into rotary type positive displacement pumps, reciprocating type positive displacement pumps and linear type positive displacement pumps. Rotary type positive displacement pumps move fluid using a rotating mechanism that creates a vacuum or low pressure region that captures and draws in fluid and then creates a high pressure region that forces that fluid into the discharge pipe.

BRIEF DESCRIPTION OF THE DISCLOSURE

According to one aspect of the disclosure, a pump assembly is provided and includes a housing having first, second and third pairs of fluid openings and first, second and third rotary pumps, which are co-rotatable about a common longitudinal axis defined through the housing to drive fluid flow relative to the first, second and third pairs of fluid openings, respectively. The first rotary pump includes an input member receptive of rotational drive energy for the first, second and third rotary pumps.

According to another aspect of the disclosure, a pump assembly is provided and includes a housing having opposed open and closed ends and plural pairs of fluid openings at plural axial locations, respectively, an end plate having an aperture secured to the housing at the open end and plural rotary pumps, which are co-rotatable at the plural axial locations, respectively, about a common longitudinal axis defined through the housing to drive fluid flow relative to the plural pairs of fluid openings, respectively. One of the plural rotary pumps includes an input member extendable through the aperture to be receptive of rotational drive energy for the plural rotary pump.

According to yet another aspect of the disclosure, a pump assembly is provided and includes a housing having opposed open and closed ends, a first pair of fluid openings at a first axial location proximate to the open end, a second pair of fluid openings at a second axial location proximate to the closed end and a third pair of fluid openings at a third axial location between the first and second axial locations, an end plate having an aperture secured to the housing at the open end and first, second and third rotary pumps, which are co-rotatable at the first, second and third axial locations, respectively, about a common longitudinal axis defined through the housing to drive fluid flow relative to the first, second and third pairs of fluid openings, respectively. The first rotary pump includes an input member extendable through the aperture to be receptive of rotational drive energy for the first, second and third rotary pumps.

BRIEF DESCRIPTION OF THE DRAWINGS

The subject matter, which is regarded as the disclosure, is particularly pointed out and distinctly claimed in the claims at the conclusion of the specification. The foregoing and other features, and advantages of the disclosure are apparent from the following detailed description taken in conjunction with the accompanying drawings in which:

The detailed description explains embodiments of the disclosure, together with advantages and features, by way of example with reference to the drawings.

DETAILED DESCRIPTION OF THE DISCLOSURE

As will be described below, a pump assembly is provided and includes a charge pump rotor, an inversion pump rotor and a scavenge pump rotor. The charge pump rotor, the inversion pump rotor and the scavenge pump rotor are co-rotatable about a common rotational axis defined through a housing of the pump assembly and all have a non-standard ratio of hub diameter to hub length. This non-standard ratio facilitates a capability of the charge pump rotor, the inversion pump rotor and the scavenge pump rotor to pump a given amount of fluid in gallon per minute (GPM) at a given number of revolutions per minute (RPM).

Figure 1:
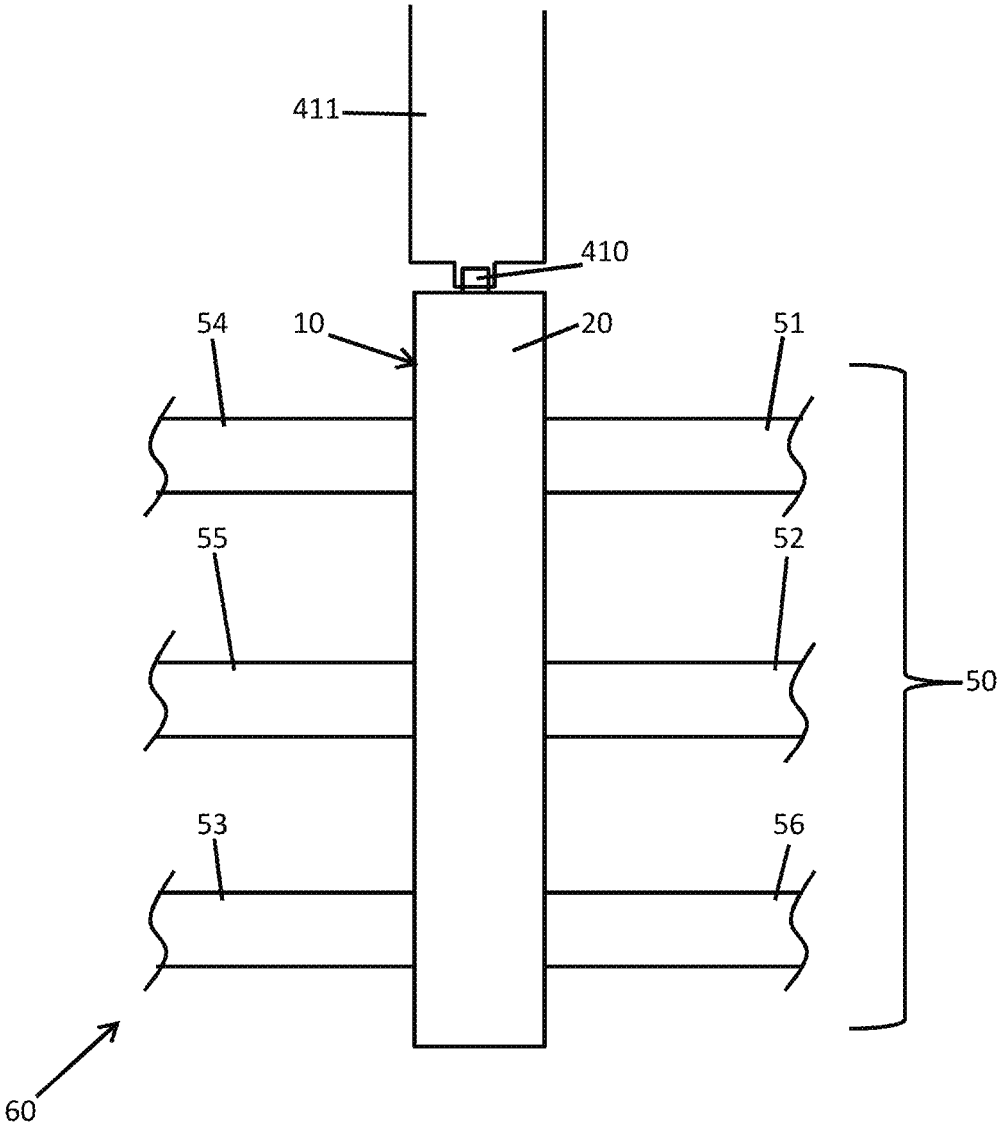
FIG. 1 is a schematic diagram of a pump assembly for disposition in a fluid supply system in accordance with embodiments.
Figure 2:
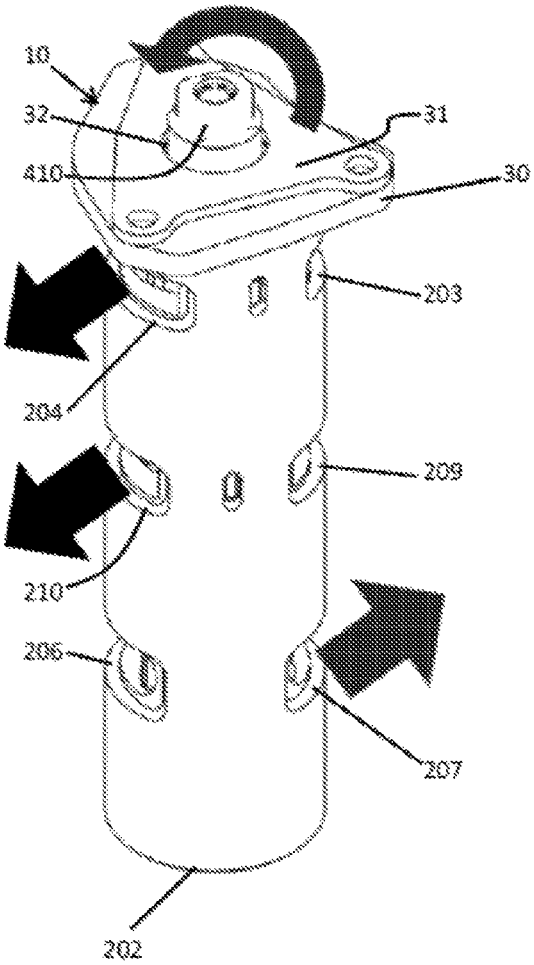
FIG. 2 is a perspective view of the pump assembly of FIG. 1.
Figure 3:
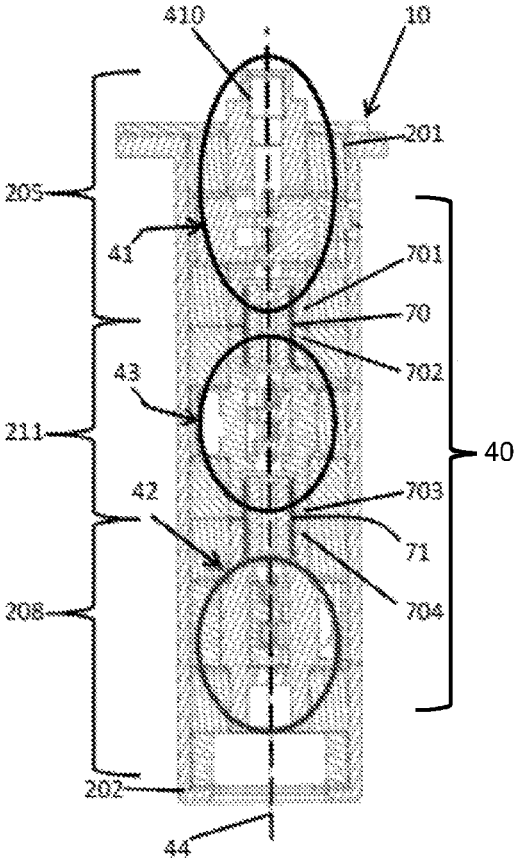
FIG. 3 is a cross-sectional view of the pump assembly of FIGS. 1 and 2.

With reference to FIGS. 1-3, a pump assembly 10 is provided and includes a housing 20, an end plate 30, plural rotary pumps 40 and multiple pairs of input and output pipes 50. The housing 20 may have a tubular or cylindrical shape and has a first, open end 201 and a second, closed end 202, which is opposite the first, open end 201. The housing 20 also has a first pair of opposite fluid openings 203, 204 at a first axial location 205, which is defined proximate to the first, open end 201, a second pair of opposite fluid openings 206, 207 at a second axial location 208, which is defined proximate to the second, closed end 202, and a third pair of fluid openings 209, 210 at a third axial location 211, which is defined between the first and second axial locations 205 and 208.

The end plate 30 has an end plate body 31 that is formed to define an aperture 32 from one side thereof to the other side. The end plate body 31 is secured to flanges of the housing 20 at the first, open end 201.

The plural rotary pumps 40 may include, for example, a first rotary pump 41, a second rotary pump 42 and a third rotary pump 43. Additional pumps may be included as well but for the purposes of clarity and brevity the case where three rotary pumps are provided will be described herein. The first, second and third rotary pumps 41, 42 and 43 are co-rotatable at the first, second and third axial locations 205, 208 and 211, respectively, about a common longitudinal axis 44. The common longitudinal axis 44 is defined through the housing 20 and may be substantially parallel with a longitudinal axis of the housing 20. Such co-rotation of the first, second and third rotary pumps 41, 42 and 43 serves to drive fluid flow relative to the first pair of fluid openings 203, 204, the second pair of fluid openings 206, 207 and the third pair of fluid openings 209, 210, respectively.

The first rotary pump 41 includes an input member 410. The input member 410 is extendable through the aperture 32 of the end plate body 31. The input member 410 is thus exposed at an exterior of the housing 20 and positioned to be receptive of rotational drive energy for the first, second and third rotary pumps 41, 42 and 43. In particular, the pump assembly 10 may include a drive shaft 411, which is connectable with the input member 410, such that rotation of the drive shaft 411 can be transmitted to the input member 410 and in turn to the first, second and third rotary pumps 41, 42 and 43.

As shown in FIGS. 1 and 2, the multiple pairs of input and output pipes 50 include first, second and third input pipes 51, 52 and 53 and first, second and third output pipes 54, 55 and 56. The first input pipe 51 is fluidly connectable to fluid opening 203 and the first output pipe 54 is fluidly connectable to fluid opening 204. The second input pipe 52 is fluidly connectable to fluid opening 206 and the second output pipe 55 is fluidly connectable to fluid opening 207. The third input pipe 53 is fluidly connectable to fluid opening 209 and the third output pipe 56 is fluidly connectable to fluid opening 210. As such, where at least the first and second output pipes 54 and 55 and the third input pipe 53 are fluidly coupled with, for example, a generator for providing oil flow to the generator, the pump assembly 10 and the multiple pairs of input and output pipes 50 form a fluid supply system 60.

For the particular cases where the housing 20 is tubular or cylindrical, fluid openings 203 and 204 may be provided on opposite tubular/cylindrical sides of the housing 20 and circumferentially extend along respective arc-segments of the housing 20 at the first axial location 205. Similarly, fluid openings 206 and 207 may be provided on opposite tubular/cylindrical sides of the housing 20 and circumferentially extend along respective arc-segments of the housing 20 at the second axial location 208 and fluid openings 209 and 210 may be provided on opposite tubular/cylindrical sides of the housing 20 and circumferentially extend along respective arc-segments of the housing 20 at the third axial location 211.

In accordance with further embodiments and, as shown in FIG. 3, the pump assembly 10 may include a first spline coupling 70 and a second spline coupling 71. The first spline coupling 70 is disposable between complementary interior splined ends 701/702 (see FIGS. 4 and 6) of the first rotary pump 41 and the third rotary pump 43 whereby the first and third rotary pumps 41 and 43 are connectable and co-rotatable with each other. The second spline coupling 71 is disposable between complementary interior splined ends 703/704 (see FIGS. 6 and 5) of the third rotary pump 43 and the second rotary pump 42 whereby the third and second rotary pumps 43 and 42 are connectable and co-rotatable with each other.

Figure 4:
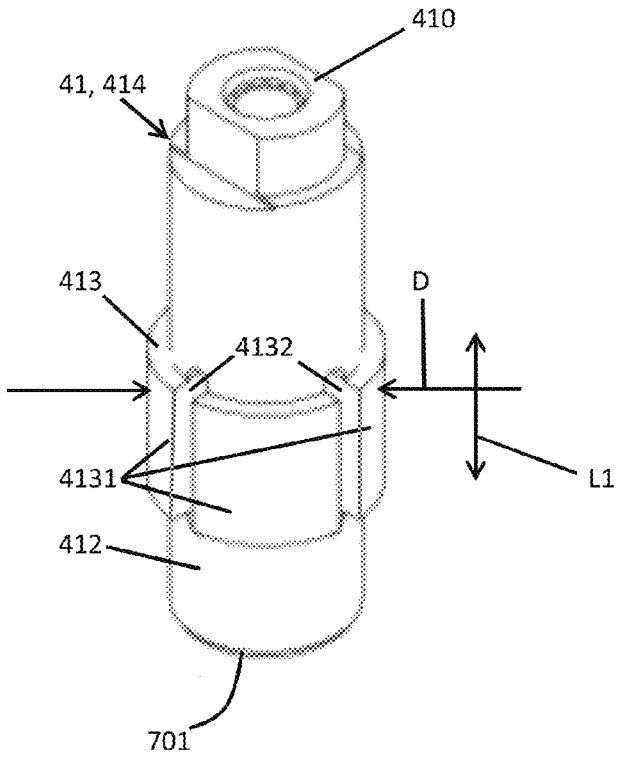
FIG. 4 is a perspective view of a charge pump rotor of the pump assembly of FIGS. 1-3.
Figure 5:
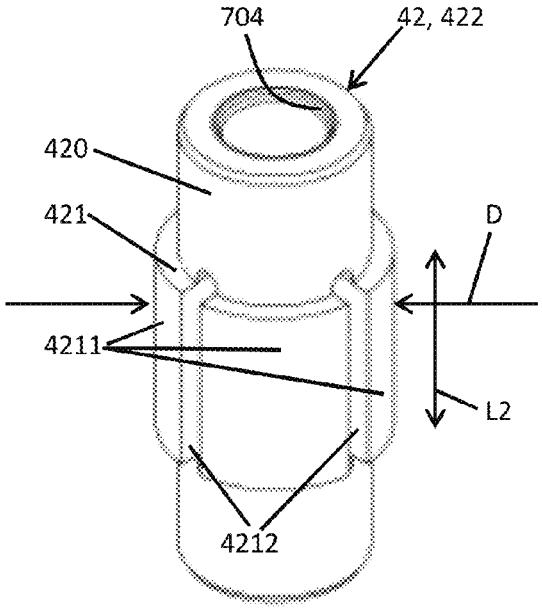
FIG. 5 is a perspective view of a scavenge pump rotor of the pump assembly of FIGS. 1-3.
Figure 6:
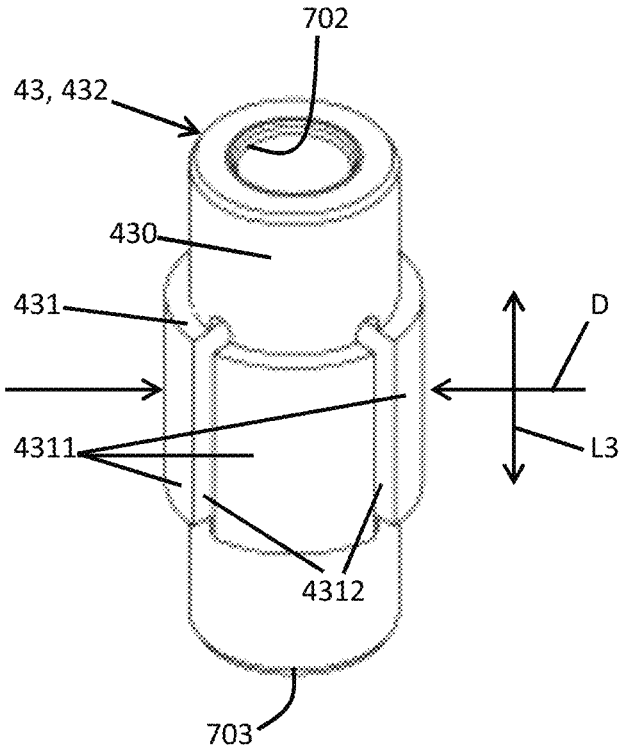
FIG. 6 is a perspective view of an inversion pump rotor of the pump assembly of FIGS. 1-3.

In accordance with embodiments and, with additional reference to FIGS. 4-6, structures and operations of the first, second and third rotary pumps 41, 42 and 43 will now be described.

The first rotary pump 41 has an elongate body 412 from a longitudinal end of which the input member 410 extends in an axial direction and a hub section 413. The input member 410 may include flats on either side thereof to mechanically interact with complementary flats on the drive shaft 411. When the pump assembly 10 is assembled, the hub section 413 corresponds in position to the first axial location 205 of the housing 20. The hub section 413 includes multiple blades 4131 arranged annularly about the elongate body 412 and slots 4132 defined to extend longitudinally between adjacent blades 4131. The multiple blades 4131 define an outer diameter that closely fits with an inner diameter of the housing 20. Thus, as the first rotary pump 41 rotates within the housing 20, fluid may be drawn into each of the advancing slots 4132 from the first input pipe 51 due to a high pressure condition therein and subsequently expelled into the first output pipe 54 due to a low pressure condition therein or centrifugal force.

The second rotary pump 42 has an elongate body 420 and a hub section 421. When the pump assembly 10 is assembled, the hub section 421 corresponds in position to the second axial location 208 of the housing 20. The hub section 421 includes multiple blades 4211 arranged annularly about the elongate body 420 and slots 4212 defined to extend longitudinally between adjacent blades 4211. The multiple blades 4211 define an outer diameter that closely fits with an inner diameter of the housing 20. Thus, as the second rotary pump 42 rotates within the housing 20, fluid may be drawn into each of the advancing slots 4212 from the second input pipe 52 due to a high pressure condition therein and subsequently expelled into the second output pipe 55 due to a low pressure condition therein or centrifugal force.

The third rotary pump 43 has an elongate body 430 and a hub section 431. When the pump assembly 10 is assembled, the hub section 431 corresponds in position to the third axial location 211 of the housing 20. The hub section 431 includes multiple blades 4311 arranged annularly about the elongate body 430 and slots 4312 defined to extend longitudinally between adjacent blades 4311. The multiple blades 4311 define an outer diameter that closely fits with an inner diameter of the housing 20. Thus, as the third rotary pump 43 rotates within the housing 20, fluid may be drawn into each of the advancing slots 4312 from the third input pipe 53 due to a high pressure condition therein and subsequently expelled into the third output pipe 56 due to a low pressure condition therein or centrifugal force.

In accordance with further embodiments, the first rotary pump 41 may include or be provided as a charge pump 414 with a standard hub diameter D of about 0.8454 inches and a non-standard hub length L1 of about 0.5635 inches, the second rotary pump 42 may include or be provided as a scavenge pump 422 with a standard hub diameter D of about 0.8454 inches and a non-standard hub length L2 of about 0.7451 inches and the third rotary pump 42 may include or be provided as an inversion pump 432 with a standard hub diameter D of about 0.8454 inches and a non-standard hub length L3 of about 0.5635 inches. With these dimensions, as shown in FIG. 2, the first and third rotary pumps 41 and 43 direct fluid flow in a first direction at about 10.85 GPM at 7176 RPM and the second rotary pump 42 directs fluid flow in a second direction opposite the first direction at about 11.51 GPM at 7176 RPM.

The dimensions provided above are exemplary and it is to be understood that additional or alternative dimensions can be used for the various hub sections 413, 421 and 431 of the first, second and third rotary pumps 41, 42 and 43. In each case, the additional or alternative dimensions will result in a modification of the pumping capability of the first, second and third rotary pumps 41, 42 and 43 at a same RPM. It is to be further understood that the exemplary dimensions and the additional or alternative dimensions will also provide for modification pumping capabilities for any corresponding modifications of RPMs.

While the disclosure is provided in detail in connection with only a limited number of embodiments, it should be readily understood that the disclosure is not limited to such disclosed embodiments. Rather, the disclosure can be modified to incorporate any number of variations, alterations, substitutions or equivalent arrangements not heretofore described, but which are commensurate with the spirit and scope of the disclosure. Additionally, while various embodiments of the disclosure have been described, it is to be understood that the exemplary embodiment(s) may include only some of the described exemplary aspects. Accordingly, the disclosure is not to be seen as limited by the foregoing description, but is only limited by the scope of the appended claims.

What is claimed is:

1. A pump assembly, comprising:

a housing having first, second and third pairs of fluid openings;

first, second and third rotary pumps, which are co-rotatable about a common longitudinal axis defined through the housing to drive fluid flow relative to the first, second and third pairs of fluid openings, respectively, the first rotary pump comprising an input member receptive of rotational drive energy for the first, second and third rotary pumps;

a first spline coupling, which is disposable between complementary interior splined ends of and co-rotatable about the common longitudinal axis with the first and third rotary pumps by which the first and third rotary pumps are connectable; and a second spline coupling, which disposable between complementary interior splined ends of and co-rotatable about the common longitudinal axis with the third and second rotary pumps by which the third and second rotary pumps are connectable.

2. The pump assembly according to claim 1, further comprising a drive shaft coupled to the input member.

3. The pump assembly according to claim 1, further comprising:

first input and output pipes fluidly connectable to each of the first pair of fluid openings, respectively;

second input and output pipes fluidly connectable to each of the second pair of fluid openings, respectively; and third input and output pipes fluidly connectable to each of the third pair of fluid openings, respectively.

4. The pump assembly according to claim 1, wherein the housing is tubular and each of the first, second and third pairs of fluid openings circumferentially extend along an arc-segment of the housing.

5. The pump assembly according to claim 1, wherein:

the first rotary pump comprises a charge pump, the second rotary pump comprises a scavenge pump, and the third rotary pump comprises an inversion pump.

6. A pump assembly, comprising:

a housing having first, second and third pairs of fluid openings;

charge, scavenge and inversion pumps, which are co-rotatable about a common longitudinal axis defined through the housing to drive fluid flow relative to the first, second and third pairs of fluid openings, respectively, the charge pump comprising an input member receptive of rotational drive energy for the charge, scavenge and inversion pumps, wherein the charge and inversion pumps direct fluid flow in a first direction at 10.85 gallons per minute (GPM) at 7176 RPM and the scavenge pump directs fluid flow in a second direction opposite the first direction at 11.51 GPM at 7176 revolutions per minute (RPM).

7. The pump assembly according to claim 1, wherein:

the first rotary pump comprises a charge pump with a hub diameter of 0.8454 inches and a hub length of 0.5635 inches, the second rotary pump comprises a scavenge pump with a hub diameter of 0.8454 inches and a huh length of 0.7451 inches, and the third rotary pump comprises an inversion pump with a hub diameter of 0.8454 inches and a hub length of 0.5635 inches.

8. A pump assembly, comprising:

a housing having first, second and third pairs of fluid openings;

charge, scavenge and inversion pumps with respective huh diameters of 0.8454 inches and respective hub lengths of 0.5635, 0.7451 and 0.5635 inches, which are co-rotatable about a common longitudinal axis defined through the housing to drive fluid flow relative to the first, second and third pairs of fluid openings, respectively, the charge pump comprising an input member receptive of rotational drive energy for the charge, scavenge and inversion pumps, wherein the charge and inversion pumps direct fluid flow in a first direction at 10.85 gallons per minute (GPM) at 7176 revolutions per minute (RPM) and the scavenge pump directs fluid flow in a second direction opposite the first direction at 11.51 GPM at 7176 RPM.

9. A pump assembly, comprising:

a housing having opposed open and closed ends and plural pairs of fluid openings at plural axial locations, respectively, an end plate having an aperture secured to the housing at the open end;

plural rotary pumps, which are co-rotatable at the plural axial locations, respectively, about a common longitudinal axis defined through the housing to drive fluid flow relative to the plural pairs of fluid openings, respectively, one of the plural rotary pumps comprising an input member extendable through the aperture to be receptive of rotational drive energy for the plural rotary pumps;

a first spline coupling, which is disposable between complementary interior splined ends of and co-rotatable about the common longitudinal axis with the one and a third one of the plural rotary pumps by which the one and the third one of the plural rotary pumps are connectable; and a second spline coupling, which is disposable between complementary interior splined ends of and co-rotatable about the common longitudinal axis with the third and a second one of the plural rotary pumps by which the third and the second one of the plural rotary pumps are connectable.

10. The pump assembly according to claim 9, wherein the plural rotary pumps comprise:

a charge pump that directs fluid flow in a first direction at 10.85 gallons per minute (GPM) at 7176 revolutions per minute (RPM), a scavenge pump that directs fluid flow in a second direction opposite the first direction at 11.51 GPM at 7176 RPM, and an inversion pump that directs fluid flow in a first direction at 10.85 GPM at 7176 RPM.

11. A pump assembly, comprising:

a housing having opposed open and closed ends, a first pair of fluid openings at a first axial location proximate to the open end, a second pair of fluid openings at a second axial location proximate to the closed end and a third pair of fluid openings at a third axial location between the first and second axial locations;

an end plate having an aperture secured to the housing at the open end;

first, second and third rotary pumps, which are co-rotatable at the first, second and third axial locations, respectively, about a common longitudinal axis defined through the housing to drive fluid flow relative to the first, second and third pairs of fluid openings, respectively, the first rotary pump comprising an input member extendable through the aperture to be receptive of rotational drive energy for the first, second and third rotary pumps;

a first spline coupling, which is disposable between complementary interior splined ends of and co-rotatable about the common longitudinal axis with the first and third rotary pumps by which the first and third rotary pumps are connectable; and a second spline coupling, which disposable between complementary interior splined ends of and co-rotatable about the common longitudinal axis with the third and second rotary pumps by which the third and second rotary pumps are connectable.

12. The pump assembly according to claim 11, further comprising a drive shaft coupled to the input member.

13. The pump assembly according to claim 11, further comprising:

first input and output pipes fluidly connectable to each of the first pair of fluid openings, respectively;

second input and output pipes fluidly connectable to each of the second pair of fluid openings, respectively; and third input and output pipes fluidly connectable to each of the third pair of fluid openings, respectively.

14. The pump assembly according to claim 11, wherein the housing is tubular and each of the first, second and third pairs of fluid openings circumferentially extend along an arc-segment of the housing.

15. The pump assembly according to claim 11, wherein:

the first rotary pump comprises a charge pump, the second rotary pump comprises a scavenge pump, and the third rotary pump comprises an inversion pump.

16. The pump assembly according to claim 11, wherein:

the first rotary pump comprises a charge pump with a hub diameter of 0.8454 inches and a hub length of 0.5635 inches, the second rotary pump comprises a scavenge pump with a hub diameter of 0.8454 inches and a hub length of 0.7451 inches, and the third rotary pump comprises an inversion pump with a hub diameter of 0.8454 inches and a hub length of 0.5635 inches.

17. A pump assembly, comprising:

a housing having first, second and third pairs of fluid openings;

charge, scavenge and inversion pumps, which are co-rotatable about a common longitudinal axis defined through the housing to drive fluid flow relative to the first, second and third pairs of fluid openings, respectively, the charge pump comprising an input member receptive of rotational drive energy for the charge, scavenge and inversion pumps, wherein the charge and inversion pumps direct fluid flow in a first direction at 10.85 gallons per minute (GPM) at 7176 revolutions per minute (RPM) and the scavenge pump directs fluid flow in a second direction opposite the first direction at 11.51 GPM at 7176 RPM.

18. A pump assembly, comprising:

a housing having first, second and third pairs of fluid openings;

charge, scavenge and inversion pumps with respective hub diameters of 0.8454 inches and respective hub lengths of 0.5635, 0.7451 and 0.5635 inches, which are co-rotatable about a common longitudinal axis defined through the housing to drive fluid flow relative to the first, second and third pairs of fluid openings, respectively, the charge pump comprising an input member receptive of rotational drive energy for the charge, scavenge and inversion pumps, wherein the charge and inversion pumps direct fluid flow in a first direction at 10.85 gallons per minute (GPM) at 7176 revolutions per minute (RPM) and the scavenge pump directs fluid flow in a second direction opposite the first direction at 11.51 GPM at 7176 RPM.

* * * * *